US006752727B2

(12) United States Patent
Harada et al.

(10) Patent No.: US 6,752,727 B2
(45) Date of Patent: Jun. 22, 2004

(54) GOLF CLUB HEAD AND METHOD OF MANUFACTURING THE SAME

(75) Inventors: Mutsumi Harada, Hamamatsu (JP); Hiroaki Inoue, Hamamatsu (JP); Atsushi Uchida, Hamamatsu (JP); Tatsuya Hirakawa, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 52 days.

(21) Appl. No.: 09/776,505

(22) Filed: Feb. 2, 2001

(65) Prior Publication Data

US 2001/0014627 A1 Aug. 16, 2001

(30) Foreign Application Priority Data

Feb. 3, 2000 (JP) ..... P2000-032602

(51) Int. Cl.[7] ..... A63B 53/04
(52) U.S. Cl. ..... 473/342; 473/345; 473/349
(58) Field of Search ..... 473/324, 325, 473/342, 345, 346, 349, 332, 329, 347, 348; 273/DIG. 23; 148/669

(56) References Cited

U.S. PATENT DOCUMENTS

| | | | | | |
|---|---|---|---|---|---|
| 5,205,560 | A | * | 4/1993 | Hoshi et al. | 473/345 |
| 5,405,136 | A | * | 4/1995 | Hardman | |
| 5,423,535 | A | * | 6/1995 | Shaw | |
| 5,573,467 | A | * | 11/1996 | Chou et al. | 473/289 |
| 5,720,674 | A | * | 2/1998 | Galy | 473/345 |
| 5,755,627 | A | * | 5/1998 | Yamazaki | |
| 5,961,394 | A | * | 10/1999 | Minabe | |
| 6,228,189 | B1 | * | 5/2001 | Oyama | |
| 6,402,639 | B1 | * | 6/2002 | Iwata | |
| 6,558,273 | B2 | * | 5/2003 | Kobayashi et al. | 473/349 |

* cited by examiner

*Primary Examiner*—Sebastiano Passaniti
(74) *Attorney, Agent, or Firm*—Dickstein, Shapiro, Morin & Oshinsky, LLP.

(57) ABSTRACT

By hot pressing a cold rolled β type titanium alloy which has not been subjected to solution heat treatment into a predetermined shape, it is possible to obtain a part with a cold rolled metallurgical texture in its approximately central portion in the thickness direction, and a solution heat treatment metallurgical texture in its other portions, and a golf club head is manufactured using this part as a face member.

8 Claims, 2 Drawing Sheets

GOLF CLUB HEAD AND METHOD OF MANUFACTURING THE SAME

BACKGROUND OF THE INVENTION

1. Field of the Invention

The present invention relates to a golf club head and a method of manufacturing the same, and more specifically, it relates to a golf club head which can provide high durability and an excellent feel on striking the ball (the feeling on impact with the ball), and a method of manufacturing the same.

This application is based on Patent Application No. 2000-32602, filed in Japan, the contents of which are incorporated herein by reference.

2. Description of the Related Art

Hitherto, golf club heads using face members made by pressing a β type titanium alloy which has been subjected to solution heat treatment have been known.

However, in such prior art golf club heads, in terms of the material properties, the face portion has elasticity, but does not have sufficient strength, which is somewhat disadvantageous from the viewpoint of durability.

Further, golf club heads provided with face members which are made by cold pressing a cold rolled β type titanium alloy which has not been subjected to solution heat treatment are also known. Compared to the above-mentioned golf club heads which are provided with face members which have been subjected to solution heat treatment, the face portions of these golf club heads have higher strength, but since they are not solution heat treated, there is a large amount of residual stress in the interior of the metal, and because their elasticity is also small, there are the disadvantages that the face portion is easily cracked, the feel on striking the ball is stiff, and a good feel on striking the ball cannot be obtained.

The present invention was made in order to overcome these disadvantages, and it is an object of the present invention to provide a golf club head with increased strength and at the same time, improved durability, and which can further provide a good feel on striking the ball.

SUMMARY OF THE INVENTION

In order to achieve the above goals, the present invention employs a method wherein parts formed into a predetermined shape by hot pressing a cold rolled β type titanium alloy which has not been subjected to solution heat treatment are used for at least the face member. As a result of using this method, it is possible to obtain approximately the same degree of strength as for a golf club head made of a cold pressed β type titanium alloy which has not been subjected to solution heat treatment, with a surface which does not easily crack, with greatly improved durability, and which also has a mild feel on striking the ball.

According to the present invention, the durability, of the face member is increased, and therefore, it becomes possible to make the face member thinner. When making the face member thinner, the remaining weight can be placed around the periphery or on the sole of the head, and the head can be designed so that the moment of inertia can be increased, and/or the center of gravity can be made lower and/or deeper, and as a result of these effects, further increases in the flight distance and the directional stability can be expected.

DESCRIPTION OF THE PREFERRED EMBODIMENTS

Figure 4:
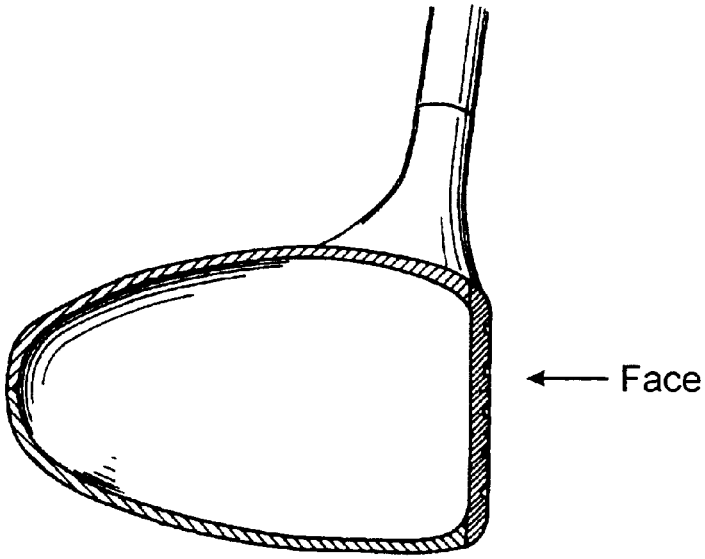
FIG. 4 illustrates a wood including the metal of an embodiment of the present invention.
Figure 5:
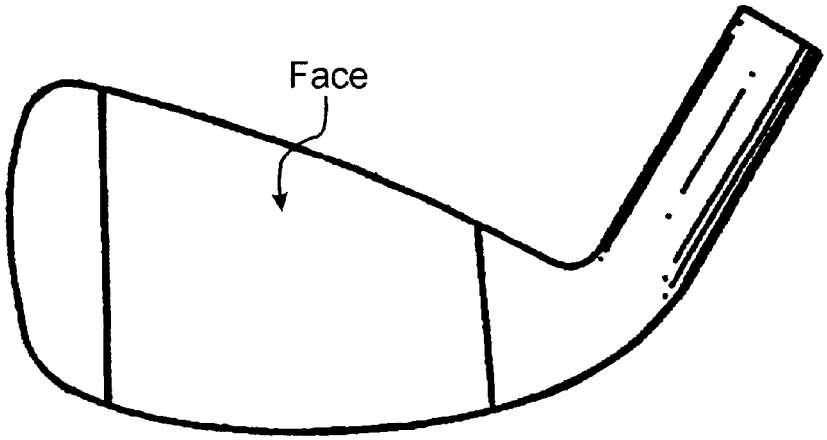
FIG. 5 illustrates an iron including a metal of an embodiment of the present invention.

In the golf club head of the present invention, at least one part of the face portion is a face member formed into a predetermined shape by hot pressing a cold rolled β type titanium alloy which has not been subjected to solution heat treatment. The face according to the present invention is preferably used for a wood type golf club (FIG. 4), however, the face may also be used for an iron type golf club (FIG. 5).

The face member formed in this way has a sandwich type constitution in which its approximately central portion in the thickness direction has a metallurgical texture corresponding to a cold rolled metallurgical texture, and the other portions have a solution heat treatment metallurgical texture (a granular metallurgical texture). The portion composed of the cold rolled metallurgical texture (the approximately central portion in the thickness direction) has a higher hardness than the other portions which have a solution heat treatment metallurgical texture (granular metallurgical texture).

Further, in the present specification, "in the thickness direction" of the face member is used to indicate the direction from the front surface side to the back surface side of the face member.

If the thickness of the above-mentioned face member of the present invention is T mm, it is preferable that the thickness of the above mentioned approximately central portion in the thickness direction is designed to be equal to or greater than 0.05 T mm and less than or equal to 0.7 T mm. Further, it is effective to apply the golf club head of the present invention to No. 1 Woods with a head volume of 250 cc or greater.

The manufacture of the golf club head of the present invention can use a method in which, after forming a cold rolled β type titanium alloy which has not been subjected to solution heat treatment into parts of a predetermined shape by hot pressing, under heating conditions of a maximum temperature of 800° C. to 1100° C., with a heat application time of 4 sec to 14 sec, these parts are used for at least the face member.

EXAMPLES

Examples of the golf head of the present invention will be explained below, in comparison with comparative examples.

Example 1

2.6 mm thick plate of a cold rolled material of a β type titanium alloy which had not been subjected to solution heat treatment was subjected to heat treatment under the same conditions as for hot pressing. That is, a cold rolled material which was not subjected to solution heat treatment was heated to a maximum temperature of 900° C. for 10 sec by high frequency heating. After this heat treatment, an aging treatment was carried out at 500° C. for 5 hours to make a sheet of material for golf club heads. Then, from the obtained sheet of material, three tensile test specimens (JIS 13B, ½ size) were cut out, and tensile testing was carried out on these tensile test specimens at a fixed speed of 1 mm/min. The results of this test are shown in Table 1. The tensile strength Ts was 1320 N/mm$^2$, the yield strength Ys was 1232 N/mm$^2$, and the elasticity E1 was 5.5%.

Figure 1:
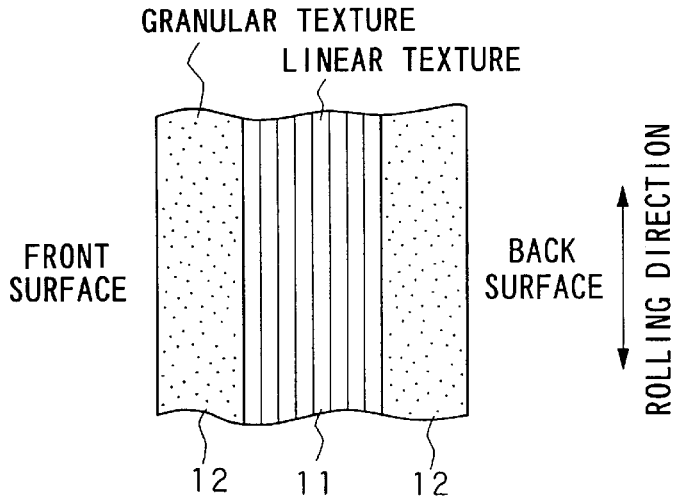
FIG. 1 schematically illustrates the structure of a cross section of the metal of an embodiment of the present invention.

Further, to observe the metallurgical texture, from the above sheet of material, heat treatment sample articles were made, and were sectioned along the thickness direction. Then, after covering the sectioned surface of the samples in a predetermined resin, and polishing, the surfaces of the sectioned faces were etched in a 3% solution of hydrofluoric acid, and the metallurgical texture was observed. As a result, as shown in FIG. 1, in the central portion in the thickness direction, a cold rolled metallurgical texture 11 (linear metallurgical texture) for compression in the thickness direction can be seen. Further, at either side in the thickness direction, a solution heat treatment metallurgical texture 12 (granular metallurgical texture) can be seen. That is, the sheet of material of the present example has a sandwich constitution in which the approximately central portion in the thickness direction and the other portions differ in their metallurgical textures, and when the hardnesses of these portions is studied, it is found that the above-mentioned central portion has a higher hardness than the other portions.

Manufacturing Example 1

The same cold rolled β type titanium alloy material of Example 1 was hot pressed, and a face member was formed, and using the same, a 250 cc golf club head was manufactured. The hot press heating conditions were a maximum temperature of 900° C. with a heat application time of 10 sec. After the welding process, aging was carried out at 500° C. for 5 hours, and polishing was carried out to obtain a golf club head. A shaft and a grip were attached to the golf club head obtained in this way, to manufacture a golf club head known as a No. 1 Wood (driver). Using this golf club, the inventor of the present invention, using a continuous impact testing apparatus he developed, tested the durability of the golf club according to the present Manufacturing Example 1, and found that even after 10000 impacts, there were no cracks at all visible on the surface of the face. Further, an assessment of the feel on striking the ball of this golf club was carried out using a group of 28 golfers with handicaps from 5 to 16. The assessment was carried out by having each of the golfers select the golf club with the best feel on striking the ball, from among three golf clubs, including the golf clubs according to the Comparative Manufacturing Examples 1 and 2 described later. The result was that 23 of the 28 golfers chose the club according to the present Manufacturing Example 1. Further, as shown in FIG. 1, in the face member of this golf club head, the hardness of the approximately central portion in the thickness direction is higher than the hardness of the other portions, moreover, the metallurgical texture has a sandwich constitution in which the approximately central portion in the thickness direction has a cold rolled metallurgical texture 11, and the other portions have a solution heat treatment metallurgical texture 12.

Further, using the same heat pressing conditions of the β type titanium alloy of Manufacturing Example 1, except that the maximum temperature was varied from 800° C. to 1100° C., and the heating time was varied from 4 to 14 sec, face members were made in the same way as in Manufacturing Example 1. Golf clubs were manufactured using these face members, and it was found that when the heating conditions are within the above ranges, results approximately equal to those of Manufacturing Example 1 are obtained.

Comparative Example 1

Figure 2:
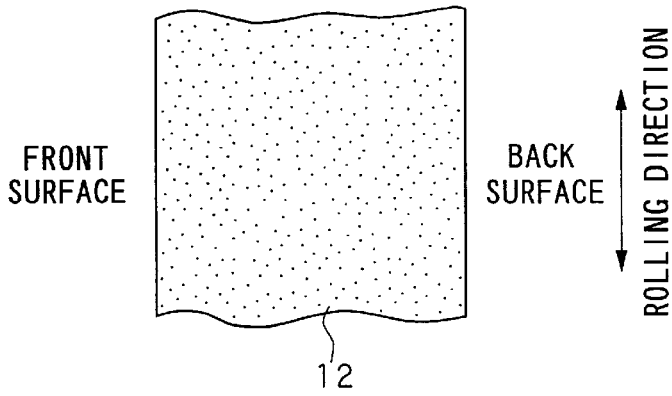
FIG. 2 schematically illustrates the structure of a cross section of the metal of a comparative example.

The same cold rolled β type titanium alloy of Example 1, after solution heat treatment at 830° C. for 5 min, and after being subjected to high frequency heating to a maximum temperature of 1000° C. for 12 sec, was aged under the same conditions as in Example 1, and was made into a sheet of material for golf club heads. Then, tensile strength testing of this sheet of material was carried out by the same method as in Example 1, and as shown in Table 1, the tensile strength Ts was 1125 N/mm$^2$, the yield strength Ys was 1050 N/mm$^2$, and the elasticity E1 was 6.0%. Further, the metallurgical texture was observed in the same way as for Example 1, and as shown in FIG. 2, a solution heat treatment metallurgical texture 12 (granular metallurgical texture) was observed throughout the sample.

Comparative Manufacturing Example 1

The same cold rolled β type titanium alloy material as that of Comparative Example 1, after being subjected to the same solution heat treatment as in Comparative Example 1, was formed into a face member by hot pressing, and was used to manufacture a golf club head in the same way as the above Manufacturing Example 1. The heating conditions of the solution heat treatment were a maximum temperature of 830° C. for 5 min, and the heating conditions of the hot pressing were a maximum temperature of 1000° C., and a heat application time of 12 sec. After the welding process, a golf club was obtained by the same process as in the above Manufacturing Example 1. Using the obtained golf club, assessments of the durability and the feel on striking the ball were carried out by the same methods as in the above Manufacturing Example 1. As a result, as shown in Table 1, cracking occurred in the central portion of the face surface after 7523 impacts. Further, among the golf clubs of the above Manufacturing Example 1, the present Comparative Manufacturing Example 1, and the following Comparative Manufacturing Example 2, only 4 out of 28 golfers chose the golf club according to the present Comparative Manufacturing Example 1 as the golf club with the best feel on hitting the ball.

Comparative Example 2

Figure 3:
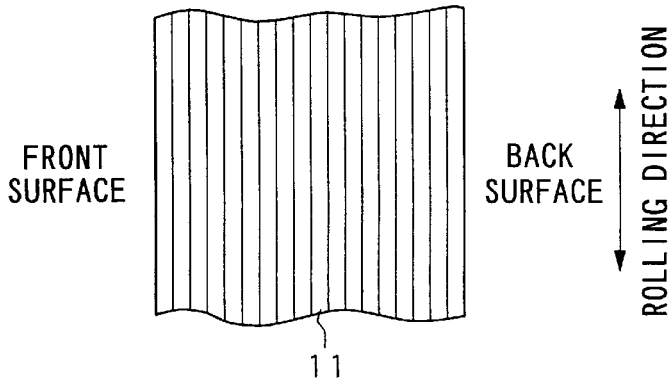
FIG. 3 schematically illustrates the structure of a cross section of the metal of a comparative example.

The same cold rolled β type titanium alloy material of Example 1 was subjected only to an aging treatment under the same conditions as those of Example 1, and a sheet of golf club head material was made. Then, tensile strength testing of this sheet of material was carried out by the same method as in Example 1, and as shown in Table 1, the tensile strength Ts was 1405 N/mm$^2$, the yield strength Ys was 1380 N/mm$^2$, and the elasticity E1 was 0.9%. Further, the metallurgical texture was observed in the same way as for Example 1, and as shown in FIG. 3, a cold rolled metallurgical texture 11 (linear metallurgical texture) was observed throughout the sample.

Comparative Manufacturing Example 2

A process approximately the same as that used in the formation of the sheet of material in the above Comparative Example 2 was followed, and a face member was formed from a cold rolled β type titanium alloy material, and a 250 cc golf club head was manufactured using this face member. That is, after cold pressing the above mentioned cold rolled material, a golf club head was obtained by carrying out the same process as in the above Example 1. Then, using a golf club provided with this golf club head, assessments of the durability and feel on striking the ball were carried out using the same methods as in the above Example 1, and as shown in Table 1, cracking occurred in the central portion of the, face surface after 2505 impacts. Further, only 1 out of 28 golfers felt that the golf club according to the present Comparative Manufacturing Example 2 had a good feel on striking the ball.

TABLE 1

| | Example 1 | Comparative Ex. 1 | Comparative Ex. 2 |
|---|---|---|---|
| Solution Heat Treatment | No | Yes | No |
| Heat Yes/No | Yes | Yes | No |
| Treatment Temp (° C.) | 900 | 1000 | — |
| Tensile Strength ($N/mm^2$) | 1320 | 1125 | 1405 |
| Yield Strength ($N/mm^2$) | 1232 | 1050 | 1380 |
| Elongation E1 (%) | 5.5 | 6.0 | 0.9 |
| Metallurgical Cross Sectional Texture | FIG. 1 | FIG. 2 | FIG. 3 |
| Durability (Impacts) | 10000 | 7523 | 2505 |
| Feel on Striking Ball | 23 | 4 | 1 |

From these results, as shown in Table 1, it can be understood that the face member of the golf club head according to Manufacturing Example 1 has a tensile strength Ts and a yield strength Ys close to that of the face member made by cold pressing (Comparative Manufacturing Example 2), but its elasticity E1 is close to that of the face member made by hot pressing (Comparative Manufacturing Example 1). Further, the metallurgical texture of the face member, as shown in FIG. 1, is formed in a sandwich constitution having a cold rolled metallurgical texture 11 in the approximately central portion in the thickness direction of the face member, and a solution heat treatment metallurgical texture (granular metallurgical texture) in the other portions. As shown in Table 1, it can be recognized that this leads to the effects that the golf club of the present Example 1 has a higher durability and a better feel on striking the ball than the golf club heads according to Comparative Examples 1 and 2.

Although the invention has been described in detail herein with reference to its preferred embodiments and certain described alternatives, it is to be understood that this description is by way of example only, and it is not to be construed in a limiting sense. It is further understood that numerous changes in the details of the embodiments of the invention, and additional embodiments of the invention, will be apparent to, and may be made by, persons of ordinary skill in the art having reference to this description. It is contemplated that all such changes and additional embodiments are within the spirit and true scope of the invention as claimed.

What is claimed is:

1. A golf club head having a face member formed by hot pressing a cold rolled β type titanium alloy which has not been subjected to solution heat treatment wherein the metallurgical texture of the approximately central portion in the thickness direction of the face member is a cold rolled metallurgical texture, and the other portions have a solution heat treatment metallurgical texture.

2. A golf club head according to claim 1, wherein the hardness of an approximately central portion in a thickness direction of the face member is higher than the hardness of other portions.

3. A golf club head according to claim 2, wherein if the thickness of the face member is T mm, the thickness of the approximately central portion in the thickness direction is greater than or equal to 0.05 T mm and less then or equal to 0.7 T mm.

4. The golf club head according to claim 1, wherein if the thickness of the face member is T mm, the thickness of the approximately central portion in the thickness direction is greater than or equal to 0.05 T mm and less then or equal to 0.7 T mm.

5. The golf club head according to claim 4, wherein the head volume is at least 250 cc.

6. The golf club head according to claim 3, wherein the head volume is at least 250 cc.

7. The golf club head according to claim 2, wherein the head volume is at least 250 cc.

8. The golf club head according to claim 1, wherein the head volume is at least 250 cc.

* * * * *